United States Patent [19]

Maehashi et al.

[11] Patent Number: 4,681,796

[45] Date of Patent: Jul. 21, 1987

[54] THERMAL TRANSFER RECORDING MEDIUM

[75] Inventors: Tatsuichi Maehashi, Hachioji; Takao Abe, Tokyo; Kunihiro Koshizuka, Hino; Yoshihiro Inaba, Hachioji, all of Japan

[73] Assignee: Konishiroku Photo Industry Co., Ltd., Tokyo, Japan

[21] Appl. No.: 778,408

[22] Filed: Sep. 20, 1985

[30] Foreign Application Priority Data

Sep. 28, 1984 [JP] Japan ..... 59-202064

[51] Int. Cl.[4] ..... B41M 5/26

[52] U.S. Cl. ..... 428/212; 428/195; 428/200; 428/218; 428/336; 428/484; 428/488.1; 428/488.4; 428/500; 428/520; 428/521; 428/522; 428/523; 428/913; 428/914

[58] Field of Search ..... 346/204; 428/212, 218, 428/321.3, 484, 488.1, 488.4, 913, 914, 195, 200, 336, 421, 422, 446, 474.4, 475.5, 480, 500, 520–524, 532

[56] References Cited

U.S. PATENT DOCUMENTS

| | | | |
|---|---|---|---|
| 4,306,498 | 12/1981 | Fujimura | 428/321.3 |
| 4,336,767 | 6/1982 | Wada | 428/321.3 |
| 4,476,179 | 10/1984 | Moriguchi et al. | 428/321.3 |

FOREIGN PATENT DOCUMENTS

| | | | |
|---|---|---|---|
| 0217392 | 12/1983 | Japan | 428/488.1 |
| 0190898 | 10/1984 | Japan | 428/321.3 |
| 0194894 | 11/1984 | Japan | 428/321.3 |

*Primary Examiner*—Bruce H. Hess

*Attorney, Agent, or Firm*—Frishauf, Holtz, Goodman & Woodward

[57] ABSTRACT

A thermal transfer recording medium having a support and at least one heat fusible coloring agent layer superposed on said support, said heat fusible coloring agent layer comprising at least one coloring agent, at least one heat fusible substance and at least one polymer, wherein the concentration of said polymer in said heat fusible coloring agent layer varies over said layer with highest concentration thereof being present in the portion of said layer most nearly adjacent said support.

17 Claims, No Drawings

THERMAL TRANSFER RECORDING MEDIUM

BACKGROUND OF THE INVENTION

The present invention relates to a thermal transfer recording medium and more particularly to a thermal transfer recording medium capable of being used repeatedly at a high density.

The invention described in Japanese Patent Publication Open to Public Inspection No. 68253/1979 (hereinafter referred to as Japanese Patent O.P.I. Publication) has been known as a thermal transfer recording medium for the purpose of multiple usage. In the technology of the aforesaid invention, a finely-porous layer is formed by means of resins and a heat-fusible ink is impregnated in the cavities in the finely-porous layer. However, the density of the dye-transfer-image obtained from the aforesaid technology is low and accordingly high energy is necessary to obtain a dye-transfer-image having a high density. Further, even if it is possible to obtain a dye-transfer-image having a high density through the application of high energy, the edges of the printed image lack sharpness. Technology similar to the foregoing is disclosed in Japanese Patent O.P.I. Publication No. 105579/1980 but the same disadvantages are observed.

In addition to the foregoing, there are known various technologies which provide a thermal transfer recording medium capable of being used repeatedly. For example, a method wherein a vinylmonomer is grafted with carbon black is shown in Japanese Patent O.P.I. Publication No. 185195/1982 and a method wherein an interlayer for the purpose of adhesion is provided between a backing material and an ink layer (heat-fusible coloring agent layer) is shown in Japanese Patent O.P.I. Publication Nos. 36698/1982, 138984/1982, 116193/1983 and 155995/1983 are well-known. In the aforementioned technologies, it is prevented that all of the coloring agents are transferred at the same time when heated by the thermal head and each technology has its advantage to a certain degree but they are not yet sufficient.

SUMMARY OF THE INVENTION

An object of the present invention is to provide a thermal transfer recording medium which is not dependent on the value of the power applied on the thermal head and which is capable of being used repeatedly and provides a recorded image that is excellent in resolving power, high in optical density, excellent in its storability over time and high in its printing quality.

It is possible, through the present invention, to obtain a thermal transfer recording medium which is not dependent on the value of the power applied on the thermal head, capable of being used repeatedly and provides a recorded image that is excellent in its resolving power, high in optical density and high in printing quality.

The inventors of the present invention, after earnest study, found that the aforesaid objects may be achieved by a thermal transfer recording medium having on the support thereof at least one layer of heat-fusible coloring agent containing a coloring agent and a heat-fusible substance, wherein a polymer is contained in the heat-fusible coloring agent layer under the condition of a continuous and/or discontinuous concentration gradient, wherein in said concentration gradient, the concentration in the part closer to the support is higher than that in the part more remote from the support.

A thermal transfer recording medium wherein a polymer is contained in a heat-fusible coloring agent layer has hitherto been well-known and Japanese Patent O.P.I. Publication Nos. 53391/1982, 217392/1983 and 219087/1983, for example, disclose the technologies wherein plural heat-fusible coloring agent layers having different melting points are coated in a laminated structure but none of them suggests the multiple usage of a thermal transfer recording medium.

The inventors of the present invention have now made possible the multiple usage of a thermal transfer recording medium their teaching of imparting a concentration gradient to the polymer contained in the heat-fusible coloring agent layer.

DETAILED DESCRIPTION OF THE INVENTION

Further explanation will be made as follows in detail.

In the thermal transfer recording medium of the present invention, a heat-fusible coloring agent layer is provided on a support. The heat-fusible coloring agent layer is formed in a layer form or in a form of two or more layers with or without a subbing layer interposed between the support and the heat-fusible coloring agent layer. When the heat-fusible coloring agent layer is formed in a form of two or more layers, interlayers may be interposed between the layers of the heat-fusible coloring agent layer.

In the present invention, polymers are contained in a heat-fusible coloring agent layer. Any of the polymers may be used without any limitation provided that the softening point or the melting point thereof is in a range of from 60° C. to 150° C. and the adhesive force between the support and the heat-fusible coloring agent layer is improved by the polymer contained or the layer-forming property of the heat-fusible coloring agent layer is improved by the polymer contained.

As examples of polymers preferably used in the present invention, polybutadiene, polystyrene, Neoprene, nitrile rubber, polymethylmethacrylate, polyethylacrylate, polyvinylacetate, polyvinyl chloride, polychloromethylacrylate, ethyl cellulose, nitrocellulose, polyethyleneterephthalate, polynitrilemethacrylate, cellulose acetate, polyvinylidene chloride, nylon 6, nylon 6,6, polynitrile acrylate, polycarbonate, polyamide, polyethylene, polypropylene, petroleum resin, polyvinyl alcohol, polyacetal, fluorine-containing resin, silicon-containing resin, natural rubber, chlorinated rubber, olefin rubber, phenol resin, urea resin, melamine resin, polyamide and others are given and these may be used in a form of an individual polymer or of copolymers thereof or in a form of a mixture containing plural items of the foregoing. Preferably one includes polybutadiene, ethylene-ethylacrylate copolymer, ethylene-vinyl acetate copolymer, polyethylene, polypropylene, petroleum resin or the like and as especially preferred ethylene-vinyl acetate copolymer, ethylene-ethylacrylate copolymer, petroleum resin and others which may be used individually or in combination of two kinds or more are mentioned.

In the case of the structure of one layer of a heat-fusible coloring agent layer, the concentration gradient of the aforesaid polymer is formed in the aforesaid layer. In this concentration gradient, the concentration is higher in the part closer to the support and the gradient itself may be either continuous or discontinuous, namely, stepwise or it may be that the gradient is continuous (or discontinuous) up to the middle toward the support from the heat-fusible coloring agent layer and discontinuous (or continuous) thereafter.

Further, in the case of the continuous gradient, the gradient may be either the one obtained by showing the concentration variation in a linear form or the one obtained by showing the concentration variation in a curve form.

Incidentally, the concentration on the surface of the heat-fusible coloring agent layer is sometimes higher than that in the inside thereof by reason of the evaporation of organic solvent, etc. but no problem is caused from such phenomenon provided that the layer including the portion of the lowest concentration and aforesaid surface portion can be transferred.

In the case of the multi-layer structure of the heat-fusible coloring agent layer, it is allowed to change the concentration of the polymer for each layer so that the concentration value is higher in the layer closest to the support. Further it is possible to provide each layer with a gradient identical to the concentration gradient in the aforesaid individual layer.

The polymer to be contained in each layer may either be the same for all layers or be different for each layer.

Regarding the concentration gradient of the polymer in the present invention, the difference between the minimum concentration and the maximum concentration near the support in the heat-fusible coloring agent layer is preferably 5%, more preferably 25% and most preferably 50% or so but it is not to be limited to these figures.

As a means for forming the concentration gradient of polymers in the present invention, any of a coating method, a polymerization method, a resolution method or the like may freely be used and in the coating method, it is possible to form the concentration gradient in the multi-layer structure by coating wherein the coating liquids have different concentration gradients, while in the polymerization method, it is possible to form the concentration gradient by changing the conditions of polymerization such as, for example, temperature and time etc. in the process of polymerization and in the resolution method, it is possible to form the concentration gradient by deterioration from the surface side by means of irradiation of ultraviolet rays or electron beam for example.

The heat-fusible substance used for the heat-fusible coloring agent layer in the present invention is solid at room temperature and is caused to be in a liquid phase reversibly by heating and an actual example of such that fusible substance includes a wax covering as for instance a vegetable wax such as carnauba wax, Japanese wax, ouricury wax, esparto wax or the like, animal wax such as beeswax, insect wax, shellac wax, spermaceti or the like, petroleum wax such as paraffin wax, microcrystalline wax, ester wax, oxidized wax or the like, mineral wax such as montan wax, ozokerite, ceresin or the like; and higher fatty acids, such as palmitic acid, stearic acid, margaric acid, behenic acid or the like; higher alcohols, such as palmityl alcohol, stearyl alcohol, behenyl alcohol, marganyl alcohol, myricyl alcohol, eicosanol or the like; higher fatty acid esters, such as cetyl palmitate, myricyl palmitate, cetyl stearate, myricyl stearate or the like; and amides such as acetamide, propionic acid amide, palmitic acid amide, stearic acid amide, amido wax or the like are given and they may be used individually or in any combination thereof. Among them, higher amides such as palmitic acid amide, stearic acid amide, oleic acid amide, amido wax or the like are especially preferred. Further, 'heat-fusible solid components which are solid at room temperature' as are described in Japanese Patent O.P.I. Publication No. 68253/1979 may be used.

Coloring agents used in the heat-fusible coloring agent layer of the present invention can be selected freely from dyes and it is possible to select from direct dyes, acid dyes, basic dyes, disperse dyes, oil soluble dyes (including metal-contained oil soluble dyes) and others. As dyes to be used in the coloring agent layer of the present invention, pigments may also be used in addition to the foregoing because the only conditions for the dyes are that they are heat-fusible substances and they are transferable (movable). Incidentally, as actual examples thereof there are given the following Kayalon polyester light yellow 5G-S (Nihon Kayaku), Oil Yellow S-7 (Hakudo), Aizen spiron yellow GRH special (Hodogaya), Sumiplasto yellow FG (Sumitomo), Aizen spiron yellow GRH (Hodogaya) and others are used preferably as a yellow dye. As a red dye, Diaceliton fast red R (Mitsubishi Kasei), Dianics brilliant red BS-E (Mitsubishi Kasei), Sumiplasto red FB (Sumitomo), Sumiplasto red HFG (Sumitomo), Kayalon polyester pink RCL-E (Nihon Kayaku), Aizen spiron red GEH special (Hodogaya) and others are used preferably. As a blue dye, Diaceliton fast brilliant blue R (Mitsubishi Kasei), Dianics blue EB-E (Mitsubishi Kasei), Kayalon polyester blue B-SF conc (Nihon Kayaku), Sumiplasto blue 3R (Sumitomo), Sumiplasto blue G (Sumitomo) and others are preferably used. Further, Hansa Yellow 3G and tartrazine lake etc. are used as a yellow pigment, Brilliant Carmine FB pure (Sanyo Shikiso), Brilliant Carmine 6B (Sanyo Shikiso), Alizarin Lake and others are used as a red pigment, cerulean blue, Sumika print cyanin blue GN-O (Sumitomo), Phthlocyanine Blue and others are used as a blue pigment and carbon black, Oil Black and others are used as a lack pigment.

The composition ratio of the heat-fusible coloring agent layer in the present invention is not restricted but it is preferable that the ratio of 30–95 parts (part by weight, the same shall apply hereinafter) (more preferably 40–90 parts) for heat-fusible substance, the ratio of 5–40 parts (more preferably 10–3 parts) is for coloring agent and the ratio of 0.1–30 parts (more preferably 4–20 parts) is for polymers against 100 parts of the total amount of solid matter in the heat-fusible coloring agent layer.

The heat-fusible coloring agent layer of the present invention may contain various kinds of additives in addition to aforesaid components. For example, vegetable oil such as castor oil, linseed oil and olive oil, animal oil such as whale oil and mineral oil may preferably be used.

The preferable thickness of the heat-fusible coloring agent layer in the present invention is 20 μm and below and it is more preferable that it is in the range from 1 μm to 15 μm. The thickness of the interlayer in the present invention is preferably 3 μm and less and more preferably 1 μm and less. In the case of multi-layer structures, the thickness of each layer may be either the thickness corresponding to a one time thermal transfer or the thickness corresponding to multiple thermal transfers.

It is desirable that the support to be used for the thermal transfer recording medium has a heat resistance and a high dimensional stability as well as a high surface smoothness. As a support material, papers such as ordinary paper, condenser paper, laminated paper, coated paper or the like, resin films such as polyethylene, polyethyleneterephthalate, polystyrene, polypropylene, polyamide or the like, paper-resin film composite material and metallic sheet such as aluminum foil are preferably used. The thickness of the support is usually 60 μm and less, preferably is in the range of 1–25 μm, more preferably is in the range of 1.5–15 μm and especially preferably is in the range of 1.5–8 μm for the purpose of obtaining the better thermal conductivity. Incidentally, the thermal transfer recording medium of the present invention may be provided with an over-coat layer (e.g. a protective layer) and the structure of the reverse side of the support is allowed to be any type including the provision of a backing layer such as a sticking-prevention layer or the like.

When a subbing layer is provided between the support and the heat-fusible coloring agent layer in the present invention, the subbing layer can be selected properly from hot-melt type adhesives. Actual examples are ethylene-vinyl acetate copolymer, ethylene-acrylate copolymer, polyethylene, polyamide, polyester, petroleum resin, nylon and others which may be used individually or in combination of two kinds or more thereof. The thickness of the subbing layer is preferably 0.5–1 μm.

EXAMPLES

Examples of the present invention will be shown below but the scope of the present invention is never be limited thereto.

EXAMPLE 1

The following composite A for the heat-fusible coloring agent layer was coated on polyethyleneterephthalate film having a thickness of 4 μm in order that the thickness of the coated layer after drying was 2 μm. On the aforesaid coated layer, the following composite B for the heat-fusible coloring agent layer was coated to obtain 2 μm thickness of the coated layer after drying and further on that layer, the following composite C for the heat-fusible coloring agent layer was coated so that 2 μm thickness of the coated layer after drying was obtained, thus the thermal transfer recording medium (a) of the present invention was obtained.

| | % by weight |
|---|---|
| <composite A> | |
| carnauba wax | 32.5 |
| paraffin wax ({paraffin solid 32030 (made by Kanto Kagaku Co.) melting point 62~64° C.} | 32.5 |
| carbon black | 20.0 |
| polyethylene | 2.0 |
| ethylene-vinylacetate copolymer (NUC-3160 made by Nihon Unicar Co.) | 13.0 |
| <composite B> | |
| carnauba wax | 35.0 |
| paraffin wax {paraffin solid 32030 (made by Kanto Kagaku Co.) melting point 62~64° C.} | 35.0 |
| carbon black | 20.0 |
| polyethylene | 2.0 |
| ethylene-vinylacetate copolymer (NUC-3160 made by Nihon Unicar Co.) | 8.0 |
| <composite C> | |
| carnauba wax | 37.5 |
| paraffin wax {paraffin solid 32030 (made by Kanto Kagaku Co.) melting point 62~64° C.) | 37.5 |
| carbon black | 20.0 |

-continued

| | % by weight |
|---|---|
| polyethylene | 2.0 |
| ethylene-vinylacetate copolymer (NUC-3160 made by Nihon Unicar Co.) | 3.0 |

For the purpose of comparison, the aforesaid composite C for the heat-fusible coloring agent layer was exclusively coated onto polyethyleneterephthalate film having a thickness of 4 μm in order that the thickness of 6 μm of the coated layer after drying was obtained, thus the thermal transfer recording medium (b) was obtained.

For the purpose of further comparison, the aforesaid composite A for the heat-fusible coloring agent layer was exclusively coated in the same way as the thermal transfer recording medium (b) in order that the thickness of 6 μm of the coated layer after drying was obtained, thus the thermal transfer recording medium (c) was obtained.

The thermal transfer recording medium (a), (b) and (c) thus prepared were given energy of applied power of 0.6 W per one heating element and of applied time of 0.7 milliseconds in the thermal printer (an experimental model equipped with a thin-type line thermal head having a heating element density of 8 dots/mm) was used and the recording (printing) was made on ordinary paper.

Printing was repeated three times in a way wherein the same portion of the recording medium was used every time by positioning the thermal head after each printing. As paper an ordinary paper, wood free paper (Bekk smoothness, 100 seconds) on the market was used.

As a result, transferred images having the optical reflection density of 1.20, 1.28 and 1.21 respectively were obtained from three cycles of recording when the thermal transfer recording medium (a) was used. In this case, no difference was observed among transferred images obtained from three cycles of recording.

Next, the applied power per one heating element was changed within a range from 0.35 mJ/dot to 0.50 mJ/dot. In this case, the phenomenon of scratched image or blurred image in some measure was observed on the printed image but the optical reflection density of about 1.2 was maintained and it was possible to use repeatedly three times.

When the thermal transfer recording medium (b) was used, an image having the optical reflection density of 1.80 was obtained through a single transferring. However, it was not possible to use the same repeatedly because a transferring of almost all layers was made through a single transferring.

When the thermal transfer recording medium (c) was used, transferred images having the optical reflection density of 0.70, 0.55 and 0.45 respectively were obtained through three cycles of transferring and it was possible therefore to use medium (c) repeatedly but the optical reflection density was low for all transferred images.

What is claimed is:

1. A thermal transfer recording medium having a support and at least one heat fusible coloring agent layer superposed on said support, said heat fusible coloring agent layer comprising at least one coloring agent, at least one heat fusible substance and at least one polymer, wherein the concentration of said polymer in said heat fusible coloring agent layer varies over said layer with the highest concentration thereof being present in the portion of said layer most nearly adjacent said support.

2. The thermal transfer recording medium of claim 1, wherein the softening point or melting point of said polymer is in the range of 60° C. to 150° C.

3. The thermal transfer recording medium of claim 1, wherein said polymer is selected from the group consisting of polybutadiene, polystyrene, Neoprene, nitrile rubber, polymethylmethacrylate, polyethylacrylate, polyvinylacetate, polyvinyl chloride, polychloromethylacrylate, ethyl cellulose, nitrocellulose, polyethyleneterephthalate, polynitrilemethacrylate, cellulose acetate, polyvinylidene chloride, nylon 6, nylon 66, polynitrile acrylate, polycarbonate, polyamide, polyethylene, polypropylene, petroleum resin, polyvinyl alcohol, polyacetal, fluorine-containing resin, silicon-containing resin, natural rubber, chlorinated rubber, olefin rubber, phenol resin, urea resin, melamine resin, polyamide.

4. The thermal transfer recording medium of claim 1, wherein said polymer is selected from the group consisting of polybutadiene, ethylene-ethylacrylate copolymer, ethylene-vinyl acetate copolymer, polyethylene, polypropylene, petroleum resin.

5. The thermal transfer recording medium of claim 1, wherein the coloring agent layer contains said polymer in an amount of 0.1 to 30 parts by weight of the total amount of said coloring agent layer.

6. The thermal transfer recording medium of claim 5, wherein said coloring agent layer contains said polymer in an amount of 4 parts to 20 parts by weight of the total amount of said coloring agent layer.

7. The thermal transfer recording medium of claim 5, wherein said coloring agent layer contains said heat-fusible substance in an amount of 20 parts to 95 parts and said coloring agent in an amount of 5 parts to 40 parts by weight of the total amount of said coloring agent layer.

8. The thermal transfer recording medium of claim 1, wherein said heat-fusible coloring agent layer has a thickness of 20 μm and less.

9. The thermal transfer recording medium of claim 8, wherein said heat fusible coloring agent layer has a thickness in the range of 1 to 15 μm.

10. The thermal transfer recording medium of claim 1, wherein said medium comprises two or more coloring agent layers and a interlayer between them.

11. The thermal transfer recording medium of claim 1, wherein a subbing layer is present between said support and said heat fusible coloring agent layer.

12. The thermal transfer recording medium of claim 11 wherein said subbing layer has a thickness of 0.5–1 μm.

13. The thermal transfer recording medium of claim 11 wherein said subbing layer is comprised of a hot melt adhesive.

14. The thermal transfer recording medium of claim 1 wherein only one heat fusible coloring agent layer is present and wherein the concentration of polymer in said layer varies in a continuous manner.

15. The thermal transfer recording medium of claim 1 wherein only one heat fusible coloring agent layer is present and wherein the concentration of polymer in said layer varies in a discontinuous manner.

16. The thermal transfer recording medium of claim 1 wherein at least two heat fusible coloring agent layers are present and the concentration of said polymer in each layer varies so that the concentration of polymer of the layer adjacent said support is higher than that of any of the superposed layers.

17. The thermal transfer recording medium of claim 1 wherein the difference in concentration of said polymer between the minimum concentration and the maximum concentration most nearly adjacent said support is 5%.

* * * * *